US007223114B2

(12) United States Patent
Tateishi et al.

(10) Patent No.: US 7,223,114 B2
(45) Date of Patent: May 29, 2007

(54) CONNECTOR ASSEMBLY

(75) Inventors: Masashi Tateishi, Shizuoka (JP); Kazuto Ohtaka, Shizuoka (JP)

(73) Assignee: vYazaki Corporation, Tokyo (JP)

( * ) Notice: Subject to any disclaimer, the term of this patent is extended or adjusted under 35 U.S.C. 154(b) by 0 days.

(21) Appl. No.: 11/164,078

(22) Filed: Nov. 9, 2005

(65) Prior Publication Data

US 2006/0166544 A1 Jul. 27, 2006

(30) Foreign Application Priority Data

Dec. 22, 2004 (JP) ..... 2004-370502

(51) Int. Cl.
*H01R 13/06* (2006.01)

(52) U.S. Cl. ..... 439/354

(58) Field of Classification Search ..... 439/354, 439/352, 353, 357
See application file for complete search history.

(56) References Cited

U.S. PATENT DOCUMENTS 6,179,643 B1 * 1/2001 Fukuda ..... 439/358
6,319,043 B1 * 11/2001 Takatsuki et al. ..... 439/358
6,332,800 B2 * 12/2001 Kodama ..... 439/357

FOREIGN PATENT DOCUMENTS

JP 11-031554 2/1999

* cited by examiner

*Primary Examiner*—Phuong Dinh
(74) *Attorney, Agent, or Firm*—Armstrong, Kratz, Quintos, Hanson & Brooks LLP

(57) ABSTRACT

When male and female housings are attached to each other, a side projection of a locking arm contacts and presses a side engaging part to bend the locking arm in a specific amount and overlap a side projection of the locking arm with a projection of the male housing. At this time, a main engaging part contacts and presses downward a main projection of the locking arm. Then, since the projection of the male housing is under the side projection, the locking arm is temporarily supported at both sides and bent in a bow shape vertically. Then, after the male housing is inserted into the female housing further, the bend of the locking arm is released, and simultaneously the main projection and the main engaging part engage with each other to complete the attachment between the male and female housings.

5 Claims, 3 Drawing Sheets

CONNECTOR ASSEMBLY

BACKGROUND OF THE INVENTION

The priority application claims priority of Japanese Patent Application No. 2004-370502, which is hereby incorporated by reference.

1. Field of the Invention

This invention relates to a connector assembly having attachable and detachable male and female housings improving a locking feeling with a locking arm extending from one side of one of said male and female housings and supported solely at said one side.

2. Description of the Related Art

Connector assemblies having attachable and detachable male and female housings are well known. Both male and female connectors respectively include terminals to be connected. These terminals are connected and disconnected corresponding to attachment and detachment of the connectors. FIG. 6 is a perspective view showing such a conventional connector assembly. FIG. 7 is an explanatory view explaining operations and problems of the conventional connector assembly.

As shown in FIG. 6, a male housing 8 in a box-like shape is composed of a locking arm 81 extending from both sides of the housing 8 and supported at both sides, and a pair of guiding ribs 82 projecting from vicinities of both sides of the locking arm 81. A projection 81*a* projects from a top wall of the locking arm 81. A pushing member 81*b* in a square button-like shape is mounted on a vicinity of one end of the locking arm 81. On the other hand, a female housing 9 is in a box-like shape having a receiving chamber 93 of which inner diameter is substantially equal to an outer diameter of the male housing 8. A pair of guiding grooves 92 corresponding to the pair of guiding ribs 82 is mounted on the receiving chamber 93. Further, a notch 91*b* is formed on a part of the receiving chamber 93 corresponding to a shape around the pushing member 81*b* of the locking arm 81.

When attaching the male housing 8 and the female housing 9 to each other, first the guiding ribs 82 are aligned to the guiding grooves 92. Then, while the pushing member 81*b* is pushed down to deform downward the locking arm 81 at an upper side thereof, the male housing 8 is inserted into the female housing 9 in a direction shown by an arrow of FIG. 6. At this time, the projection 81*a* of the locking arm 81 moves forward while contacting a hood of the female housing 9 until locked in a hole (not shown) of the female housing 9. Then, when the projection 81*a* reaches the hole, the projection 81*a* is locked in the hole, and the deformed locking arm 81 is restored to be in a normal shape. Resultingly, attaching the male housing 8 to the female housing 9 assembles a connector assembly. In addition, when the attachment is completed, electric wires 84, 94 respectively attached to the male and female housings 8, 9 are electrically connected to each other.

Incidentally, one of prior art documents related to the present invention is JP-A, H11-31554.

In such a connector assembly, a feeling (hereunder referred to as "locking feeling") to convince that the attachment between the male connector 8 and the female connector 9 is surely completed is important. An operator can confirm the completion of the attachment using the locking feeling as a clue. Therefore, for example, when the locking feeling is obscure, the operator is anxious or tries again, and workability may be reduced.

Accordingly, in such a connector assembly as shown in FIG. 7, the locking arm 81 is supported at both sides 81*c*, 81*d*. Being supported at both sides relatively increases a counter-force generated by the locking arm 81, and therefore, a suitable locking feeling is attained.

On the other hand, mounting the pushing member 81*b* in a vicinity of a rear end (right end in FIG. 7) of the locking arm 81 becomes difficult. The pushing member 81 must be arranged near the center of the locking arm by a specific distance L from the rear end. If the male housing 8 is formed according to the arrangement of the pushing member 81*b*, the "L" part will project from the male housing 8 as shown in FIGS. 6 and 7. Otherwise if the male housing 8 is formed in a manner that the rear end of the male housing is in the same plane as that of the locking arm 81, this makes the male housing 8 larger and is not preferable.

Further, if the locking arm 81 is supported at both sides, the locking feeling is suitable, however, as the counter-force becomes larger, locking and unlocking operations for attaching the male housing 8 to and detaching from the female housing 9 become more difficult.

In short, as shown in FIGS. 6 and 7, the locking arm 81 supported at both sides has problems that the projection "L" of FIGS. 6, 7 projects outward from the pushing member 81*b*, and unlocking operation becomes difficult.

Accordingly, an object of this invention is to provide a connector assembly having no projection projecting from a locking arm and giving a locking feeling like that of a locking arm supported at both sides of a connector assembly. Further, another object of this invention is to provide a connector assembly allowing male and female connectors to be attached and detached easily each other and giving a locking feeling like that of a locking arm supported at both sides of a connector assembly.

SUMMARY OF THE INVENTION

In order to attain the object, according to the present invention, there is provided a connector assembly including:

male and female housings being attachable to and detachable from each other;

a locking arm extending from one side of one of the male and female housings, being supported solely at said one side, and resilient in both horizontal and vertical directions;

a main locking part mounted on the locking arm;

a side locking part mounted on a side wall of the locking arm being parallel to a direction of attaching the locking arm;

a side engaging part mounted on a receiving chamber for receiving the locking arm being formed in the other one of the male and female housings; and a main engaging part mounted on an inner wall of the receiving chamber being substantially parallel to a top wall of the locking arm, wherein when the male and female housings are attached to each other, said side engaging part presses the side locking part to bend the locking arm in the horizontal direction for making the locking arm partially contact the one of the male and female housings, and said main engaging part presses the main locking part to bend the locking arm in the vertical direction.

According to the above, when the male and female housings are attached to each other and the side locking part of the locking arm presses the side engaging part to bend the locking arm in the horizontal direction, the main engaging part contacts and presses downward the main locking part of the locking arm. However, since a part of the locking arm contacts a part of the one housing, the locking arm supported at one side is actually supported at both sides and bent in a bow shape by a press of the main locking part.

Preferably, when the horizontal bend in a specific amount is released, the side engaging part engages with the side locking part, and simultaneously the main engaging part engages with the main locking part.

According to the above, when the male and female housings are attached to each other, and the side locking part of the locking arm presses the side engaging part to bend the locking arm in the horizontal direction, the main engaging part contacts the main locking part of the locking arm to press downward the main locking part. However, since a part of the locking arm contacts a part of the one housing, the locking arm supported at one side is actually supported at both sides and bent in a bow shape by a press of the main locking part. Then, when the male and female housings are moved forward to complete the attachment, the horizontal bend in a specific amount is released, and simultaneously the main locking part and the main engaging part are engaged with each other Preferably, the connector assembly further including a pushing member mounted on an end of the locking arm, wherein the pushing member is pushed in the vertical direction to disengage the engagement between the main locking part and the main engaging part, and the engagement between the side locking part and the side engaging part.

According to the above, when the male and female housings are attached to each other, and the pushing member is pushed vertically, the engagement between the main locking part and the main engaging part, and the engagement between the side locking part and the side engaging part are disengaged. Namely, only pressing the locking arm supported at one side disengages the engagement between the main locking part and the main engaging part, and the engagement between the side locking part and the side engaging part. Further, after this disengagement, the male and female housings are easily detached by removing the male and female housings from each other with pressing the pushing member continuously.

Preferably, the connector assembly further includes a rib mounted on an inner wall of the receiving chamber opposite to the side engaging part, wherein the rib is slidable along an edge of the locking arm and supports upward the edge of the locking arm.

According to the above, when the male and female housings are attached to each other, sliding the edge of the locking arm along the rib mounted on the inner wall of the receiving chamber makes the alignment and insertion of the locking arm easy.

According to another aspect of the present invention, there is provided a connector assembly including:

male and female housings being attachable to and detachable from each other;

a locking arm extending from one side of one of the male and female housings, being supported solely at said one side, and resilient in both horizontal and vertical directions;

a first main locking part mounted on the locking arm for bending the locking arm in a vertical direction;

a second main locking part mounted on the locking arm for bending the locking arm in a horizontal direction; and a main engaging part mounted on a receiving chamber for receiving the locking arm being formed in the other one of the male and female housings, wherein when said male and female housings are attached to each other, said main engaging part presses the second main locking part to bend the locking arm in a horizontal direction for making the locking arm partially contact the one of the male and female housing, and said main engaging part presses the first main locking part to bend the locking arm in the vertical direction.

According to the above, when the male and female housings are attached to each other, the main engaging part presses the second main locking part to bend the locking arm in the horizontal direction for making the locking arm partially contact the one of the male and female housings, and the main engaging part presses the first main locking part to bend the locking arm in the vertical direction. Thereby, the locking arm supported at one side is temporarily supported at both sides.

The above and other objects, features, and advantages of the present invention will be better understood when taken in connection with the accompanying drawings and description.

DESCRIPTION OF THE PREFERRED EMBODIMENTS

First Embodiment

Figure 1:
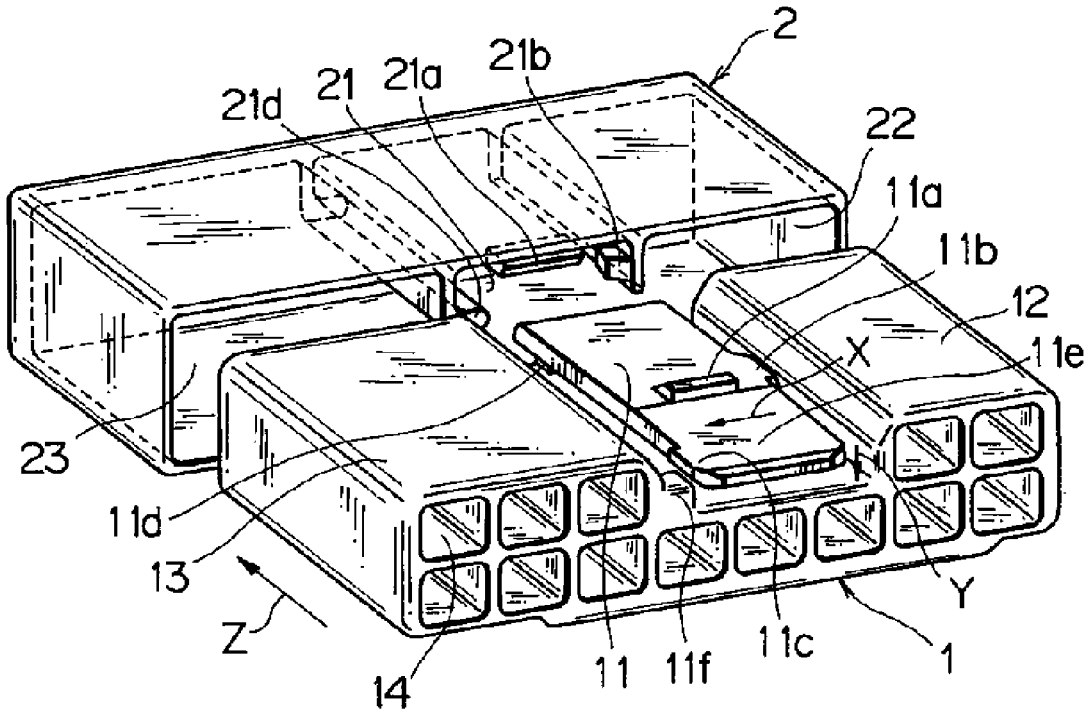
FIG. 1 is a perspective view showing a first embodiment of a connector assembly according to the present invention.
Figure 2:
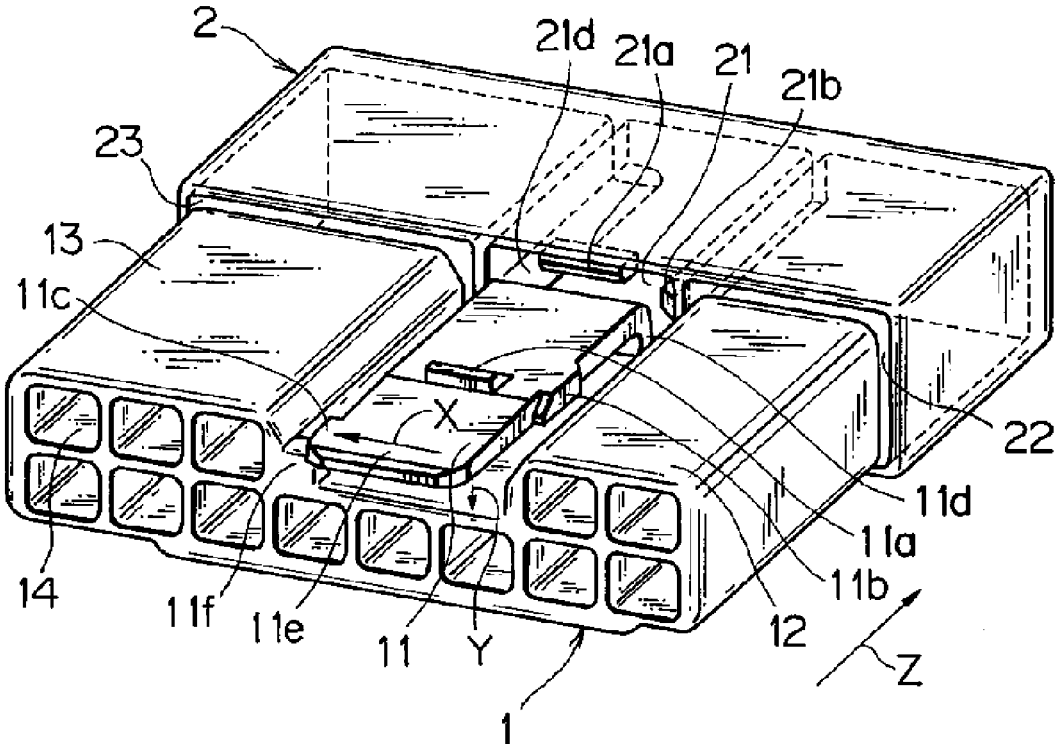
FIG. 2 is a perspective view showing the connector assembly of FIG. 1 from another view angle according to the present invention.

A first embodiment of the present invention will be explained with reference to figures. FIG. 1 is a perspective view showing a first embodiment of a connector assembly according to the present invention. FIG. 2 is a perspective view showing the connector assembly of FIG. 1 from another view angle according to the present invention.

As shown in FIG. 1, a connector assembly of the present invention includes attachable and detachable male and female housings 1, 2 made of, for example, synthetic resin. Both the male and female housings 1, 2 include a plurality of not-shown male and female terminals connected to ends of electric wires. For example, female terminals are respectively received in receiving chambers 14 of the male housing 1. These female terminals can be connected to male terminals respectively received in receiving chambers of the female housing 2. Accordingly, male and female housings 1, 2 can be referred to as female and male housings. Male or female does not limit a scope of the present invention.

The male housing 1 is in a box-like shape, having a center part on which a locking arm 11 is mounted, and side parts 12, 13. The female housing 2 is in a box-like shape, having receiving chambers 21, 22, 23 for respectively receive the side parts 11, 12, 13. When the male and female housings 1, 2 are attached to each other, the receiving chambers 21, 22, 23 receive the center and side parts respectively.

In detail, as shown in FIGS. 1 and 2, a tongue-shaped locking arm 11 supported solely at one side by a supporting part 11*d* extends from the center part of the male housing 1. The locking arm 11 is resilient in a vertical direction (as "Y" shown in FIG. 1) and a horizontal direction (as "X" shown in FIG. 1). Actually, this resiliency is attained by the solely supporting part 11*d*. A pushing member 11*e* is formed on an end of the locking arm. By pushing in the vertical direction, the pushing member 11*e* releases an engagement between a later-described main projection 11*a* and a later-described main engaging part 21*a*. Supplementary, when the engagement between the main projection 11*a* and the main engaging part 21*a* is released by pushing the pushing member 11*e*, a side projection 11*c* mounted on a side end of the locking arm 11 and a projection 11*f* mounted on the male housing 1 are not overlapped with each other. Namely, the projection 11*f* is mounted on the male housing 1 in a manner that the projection is positioned under the side projection 11*c* only when the locking arm 11 is bent in a specific amount in the horizontal direction.

Further, a side projection 11*b* having a trapezoid cross section is mounted on a side wall of the locking arm 11 parallel to the attaching direction, and opposite to the side wall on which the projection 11*c* is mounted. A main projection 11*a* also having a trapezoid cross section is mounted on a top wall of the locking arm 11. The side projection 11*b* has an uprising slope wall from front to back of FIG. 1. The main projection 11*a* has a trapezoid prism shaped wall extending in a direction substantially orthogonal to a longitudinal direction of the locking arm 11. The projection 11*a* has a precipitous front wall and a decline slope wall from front to back of FIG. 1.

Operations of main projection 11*a*, side projection 11*b*, and the like will be described later with reference to FIG. 3.

Further, in detail, as shown in FIGS. 1 and 2, the female housing 2 is in a box-like shape having an inner diameter substantially equal to an outer diameter of the male housing 1. The receiving chamber 21 of the center part corresponding to the locking arm 11 of the male housing 1 characterizes the female housing 2. The solely supporting part 11*d* of the locking arm 11 and its around is firstly inserted into the receiving chamber 21. A side engaging part 21*b* is formed on an inner wall of the receiving chamber 21. When the male and female housings are attached to each other, initially, the side engaging part 21*b* presses the side projection 21*b* to bend the locking arm 11 in a specific amount in the horizontal direction (X direction). When the attachment progresses further, the horizontal bend of the locking arm 11 is released and the side engaging part 21*b* engages with the side projection 11*b*. The side engaging part 21*b* also has an uprising slope wall from front to rear in FIG. 1, and a precipitous rear end wall.

A rib 21*d* is mounted on an inner wall opposite to the side engaging part 21*b* of the receiving chamber 21. The rib 21*d* is slidable along and supports upward an edge of the locking arm 11. The rib 21*d* extends in a direction parallel to the attaching direction. Further the main engaging part 21*a* projects from an inner wall of the receiving chamber 21. The inner wall of the receiving chamber 21 is substantially parallel to the top wall of the locking arm 11 when the male and female housings are attached to each other. The main engaging part 21*a* engages with the main projection 11*a*. When the side projection 11*b* presses the side engaging part 21*b*, the main engaging part 21*a* contacts and presses downward the main projection 11*a*. Further, when the press is released, the main engaging part 21*a* engages with the main projection 11*a*. The main engaging part 21*a* projects in a direction parallel to the main projection 11*a*.

An operation and an effect according to a connector assembly having such a configuration will be explained with reference to FIGS. 3A to 3D. FIGS. 3A to 3D are top views of main parts of male and female housings showing a flow to attach the male and female housings to each other.

As shown in FIGS. 1 and 2, the male and female housings 1, 2 fully detached from each other. Firstly, the center and the side parts 12, 13 of the male housing 1 are respectively aligned to the receiving chambers 21, 22, 23. Using edges of the rib 21*d* of the receiving chamber 21 and the locking arm 11 makes the alignment easy.

Figure 3A:
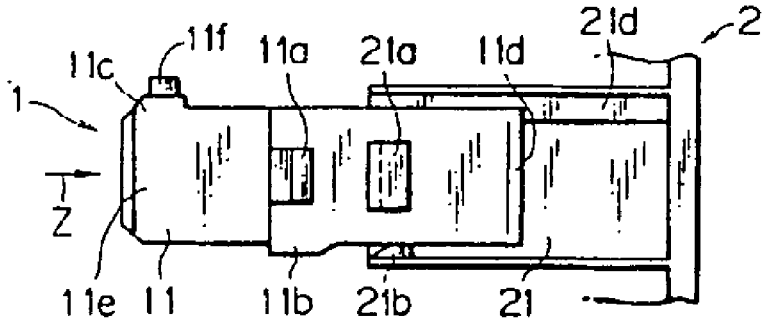
FIGS. 3A to 3D are top views of main parts of male and female housings showing a flow to attach the male and female housings to each other.

Next, as shown in FIG. 3A, the male housing 1 is inserted into the female housing 2 so that about one-third of the locking arm 11 is inserted into the receiving chamber 21. At this time, both side parts 12, 13 are also inserted into the receiving chambers 22, 23 (not shown). At this time, the main projection 11*a* and the side projection 11*b* do not contact the main engaging part 21*a* and the side engaging part 21*b* respectively. Therefore, the locking arm 11 is not bent in vertical and horizontal directions.

Figure 3B:
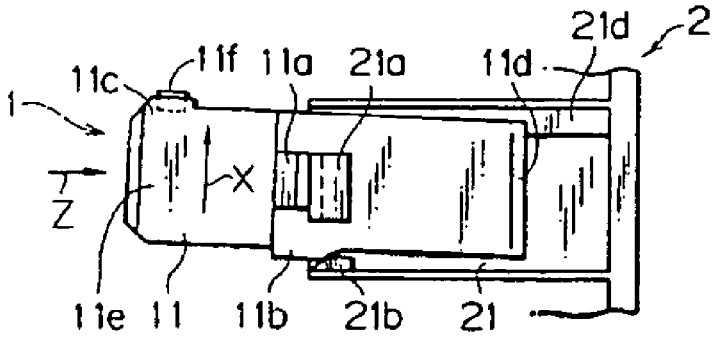

Next, from a state shown in FIG. 3A, when the male housing 1 is further inserted into the female housing 2 in a direction "Z" of FIG. 3A, the side projection 11*b* contacts the side engaging part 21*b*, and then the side engaging part 21*b* presses the side projection 11*b* to bend the locking arm 11 in a direction "X" of FIG. 3B. At this time, since the main projection 11*a* contacts the main engaging part 21*a* in an early stage, the locking arm is seldom bent in the vertical direction. Namely, before the locking arm 11 is bent in the vertical direction, the side projection 11*c* partially overlaps the projection 11*f*.

Figure 3C:
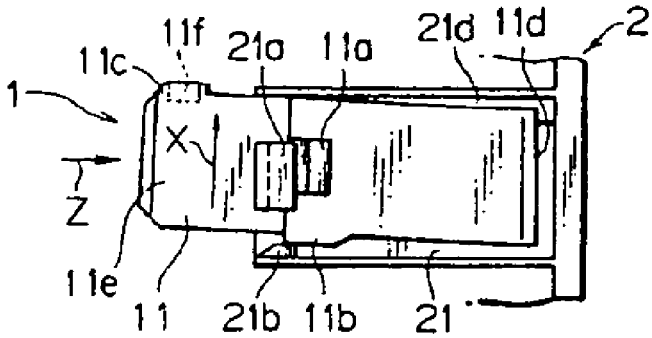

Next, from a state shown in FIG. 3B, the male housing 1 is further inserted into the female housing 2 in a direction "Z" of FIG. 3B, the side wall of the side projection 11*b* slides on the side wall of the side engaging part 21*b* and the side engaging part 21*b* presses the side projection 11*b* to bend the locking arm to the maximum in the direction "X" of FIG. 3C. At this time, since the main projection 11*a* fully contacts the main engaging part 21*a*, and the side projection 11*c* fully overlaps the projection 11*f*, the locking arm 11 is bent sufficiently in the vertical direction. Namely, the locking arm supported by the solely supporting part 11*d* is now supported by both the supporting part 11*d* and the side projection 11*c* (the projection 11*f*). In this state, since the main projection 11*a* is pressed downward sufficiently, a counter-force upward is generated for attaining a suitable locking feeling.

Figure 3D:
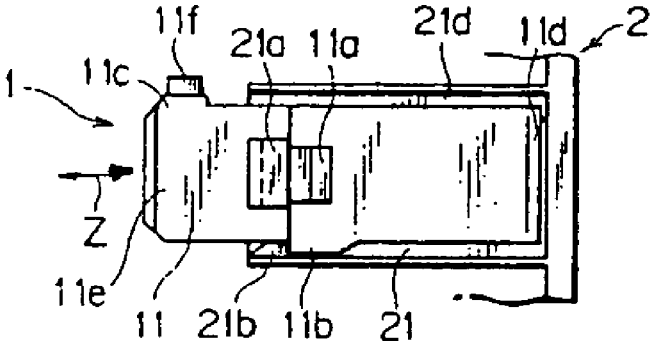

Next, from a state shown in FIG. 3C, the male housing 1 is further inserted into the female housing 2 in a direction "Z" of FIG. 3C. Then, as shown in FIG. 3D, the side projection 11*b* passes over the side engaging part 21*b* and simultaneously the main projection 11*a* passes over the main engaging part 21*a*. At this time, the locking arm 11 restores to a state having no bend. At the same time, the side projection 11*b* engages with the side engaging part 21*b* and simultaneously main projection 11*a* engages with the main engaging part 21*a*. Thus, as shown in FIG. 3D, the attachment between the male and female housings 1, 2 is completed. Incidentally, at the same time, electric wires attached to each housing are electrically connected to each other.

Figure 6:
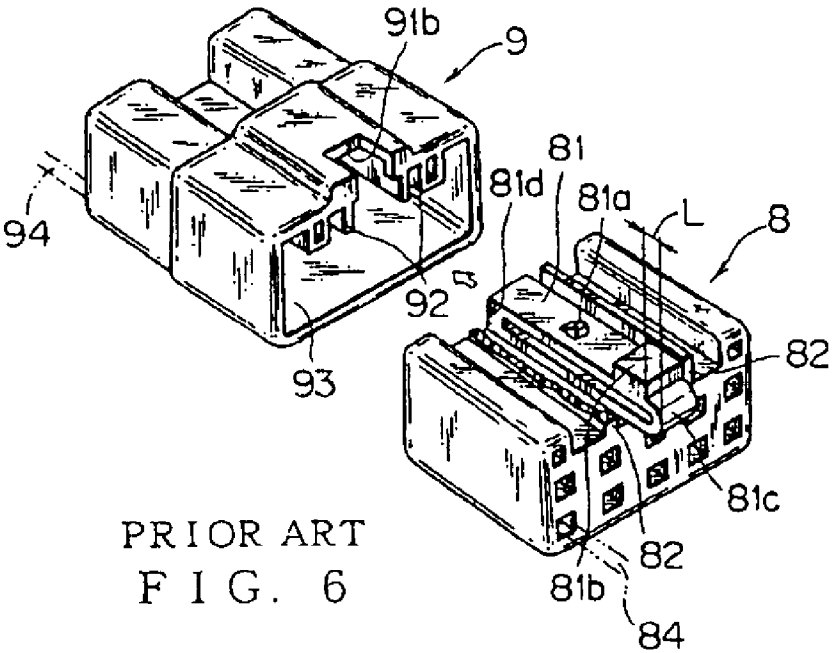
PRIOR ART FIG. 6
FIG. 6 is a perspective view showing a conventional connector assembly.
Figure 7:
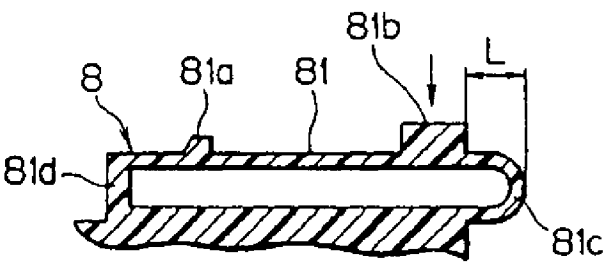
PRIOR ART FIG. 7
FIG. 7 is an explanatory view explaining an operation and a problem of the conventional connector assembly.

Accordingly, the locking arm 11 of the connector assembly according to the present invention does not need to extend backward as that of the conventional connector assembly supported at both sides shown in FIG. 6. Additionally, the connector assembly supported at one side attains a locking feeling like that of a locking arm supported at both sides of the conventional connector assembly.

Incidentally, from the attaching state shown in FIG. 3D, for detaching the male and female housings from each other, while being pushed in the vertical direction, the pushing member 11*e* is pulled out in a direction opposite to "Z'" of FIG. 3D.

Supplementary, in the attaching state, pushing the pushing member 11*e* in the vertical direction disengages the engagement between the main projection 11*a* and the main engaging part 21*a*, and simultaneously the engagement between the side projection 11*b* and the side engaging part 21*b* in the vertical direction. Further, as shown in FIG. 3D, since the side projection 11*c* does not overlap the projection 11*f* in the attaching state, pushing down and pulling out the pushing member 11*e* easily detaches the attachment between the male and female housings 1, 2. Namely, only pushing the locking arm supported at one side unlocks the lock and detaches the attachment between the male and female housings 1, 2.

As described above, according to the first embodiment of the present invention, the connector assembly of which locking arm is supported at one side has no projection in a longitudinal direction of the housing as the conventional connector assembly of which locking arm is supported at both sides has, and attains a locking feeling like that of said conventional connector assembly. Further, regarding the detachment between the male and female housings 1, 2, basically an operation of the connector assembly of which locking arm is supported at one side works, thereby the detaching operation is easy.

Incidentally, when the male and female housings are about to be attached to each other, sliding the edge of the locking arm 11 along the rib 21*d* mounted on the inner wall of the receiving chamber 21 makes the alignment and insertion of the locking arm 11 easy. Further, when the attachment between the male and female housings 1, 2 is completed, the rib 21*d* supports upward the edge of the locking arm 11 and the attachment is stabled.

In addition, "male" and "female" are named for convenience, and do not limit the present invention. Further, ribs, projections, engaging parts and the like of the first embodiment may be arranged reversely in the horizontal direction. Further, the locking mechanism is arranged on the center part of the male housing. However, the locking mechanism may be arranged on right or left side of the male housing 1, or a plurality of the locking mechanism may be arranged on the male housing 1.

Figure 4:
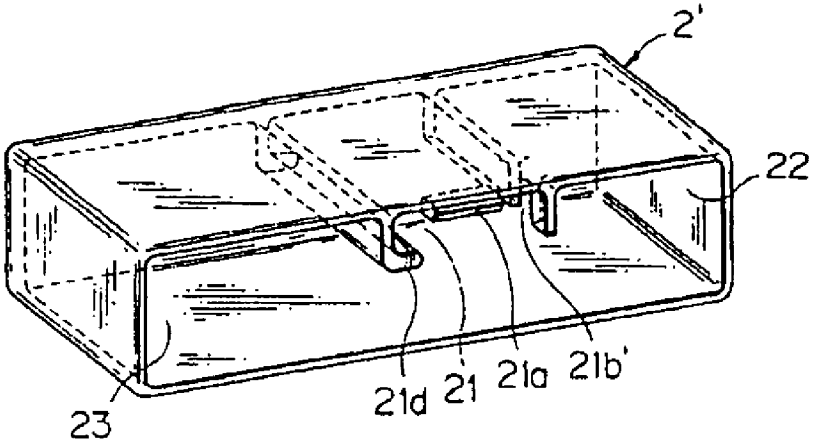
FIG. 4 is a perspective view showing a variation of the first embodiment.

As a male housing 2' shown in FIG. 4, a space 21*b*' may be arranged between the side walls instead of the side engaging part 21*b*. In this case, a figure of the side projection is modified a little for engaging with the space 21'. Further, in stead of the side projection 11*c* of the locking arm 11 and the projection 11 of the male housing 1, the side projection 11*c* may be thick (not shown) and the projection 11*f* may be omitted. Further, the side projection 11*c* may not project. Essentially, according to the present invention, the locking arm only needs to be bent in the horizontal direction to contact partially the male housing 1. In addition, at this time, the main engaging part 21*a* needs to press the main locking part 11*a* to bend the locking arm 11 in the vertical direction. Further, instead of the main projection 11*a* shown in FIG. 1, a groove (not shown) may be formed. In this case, the main engaging part 21*a* is modified a little for engaging with this groove. These modifications are included in a scope of the first embodiment of the present invention.

Second Embodiment

Figure 5:
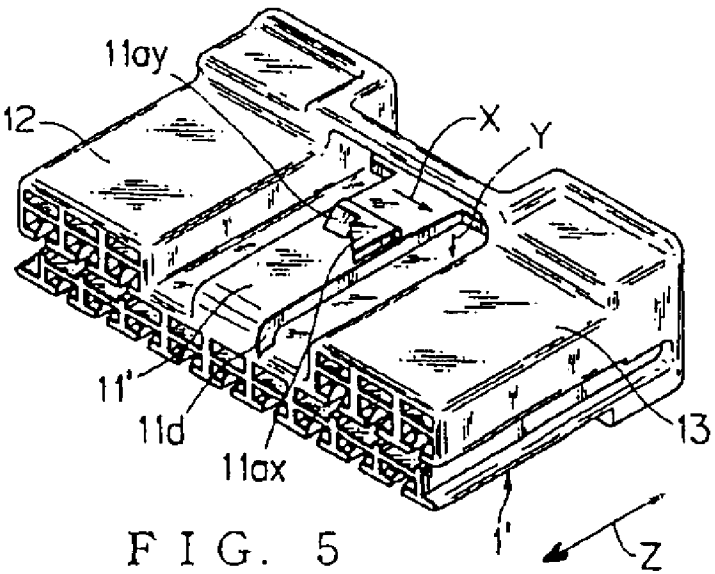
FIG. 5 is a perspective view showing a second embodiment of the connector assembly.

As shown in FIG. 5, a male housing 1' according to the second embodiment of the invention includes: a locking arm 11'; a tapered first main locking part 11*ay* for bending the locking arm 11' in a vertical direction; and a tapered second main locking part 11*ax* for bending the locking arm 11' in a horizontal direction. Thereby, the side projection 11*b* in FIG. 1 is not needed in the male housing 1', and the side engaging part 21*b* in FIG. 1 is not needed in the female housing (not shown). Other components of the male and female housings according to the second embodiment are the same as those in the first embodiment shown in FIGS. 1, 2.

According to the second embodiment of the present invention, when the male and female housings are attached to each other, the main engaging part 21*a* presses the main locking part 11*ax* to bend the locking arm 11' in the horizontal direction to make the locking arm 11' partially contact the male housing 1. At this time, the main engaging part 21*a* presses the main locking part 11*ay* to bend the locking arm 11' in the vertical direction. Thereby, the locking arm 11' supported at one side is temporarily supported at both sides. Therefore, the locking arm 11' supported at one side does not project backward unnecessarily like that of the conventional connector assembly, and attains a locking feeling like that of the conventional connector assembly.

Having now fully described the present invention, it will be apparent to one of ordinary skill in the art that many changes and modifications can be made thereto without departing from the scope of the invention as set forth herein.

What is claimed is:

1. A connector assembly comprising:

male and female housings being attachable to and detachable from each other;

a locking arm extending from one side of one of the male and female housings, being supported solely at said one side, and resilient in both horizontal and vertical directions;

a main locking part mounted on the locking arm;

a side locking part mounted on a side wall of the locking arm being parallel to a direction of attaching the locking arm;

a side projection mounted on a side wall of the locking arm, opposite to the side wall for mounting the side locking part, a side engaging part mounted on a receiving chamber for receiving the locking arm being formed in the other one of the male and female housings; and a main engaging part mounted on an inner wall of the receiving chamber being substantially parallel to a top wall of the locking arm, wherein when the male and female housings are being attached to each other, said side engaging part presses the side locking part to bend the locking arm in the horizontal direction for making the side projection contact the one of the male and female housings so as to temporarily support the locking arm at a side opposite the supported one side, and said main engaging part presses the main locking part to bend the locking arm in the vertical direction.

2. The connector assembly as claimed in claim 1, wherein when the horizontal bend in a specific amount is released, the side engaging part engages with the side locking part, and simultaneously the main engaging part engages with the main locking part.

3. The connector assembly as claimed in claim 2, further comprising a pushing member mounted on an end of the locking arm, wherein the pushing member is pushed in the vertical direction to disengage the engagement between the main locking part and the main engaging part, and the engagement between the side locking part and the side engaging part.

4. The connector assembly as claimed in claim 3, further comprising a rib mounted on an inner wall of the receiving chamber opposite to the side engaging part, wherein the rib is slidable along an edge of the locking arm and supports upward the edge of the locking arm.

5. A connector assembly comprising:

male and female housings being attachable to and detachable from each other;

a locking arm extending from one side of one of the male and female housings, being supported solely at said one side, and resilient in both horizontal and vertical directions;

a first main locking part mounted on the locking arm for bending the locking arm in a vertical direction;

a second main locking part mounted on the locking arm for bending the locking arm in a horizontal direction; and a main engaging part mounted on a receiving chamber for receiving the locking arm being formed in the other one of the male and female housings, wherein when said male and female housings are being attached to each other, said main engaging part presses the second main locking part to bend the locking arm in a horizontal direction for making the locking arm contact the one of the male and female housings so as to temporarily support the locking arm at a side opposite the supported one side, and said main engaging part presses the first main locking part to bend the locking arm in the vertical direction.

* * * * *

UNITED STATES PATENT AND TRADEMARK OFFICE

CERTIFICATE OF CORRECTION

PATENT NO. : 7,223,114 B2 
APPLICATION NO. : 11/164078
DATED : May 29, 2007
INVENTOR(S) : Masashi Tateisdhi et al.

It is certified that error appears in the above-identified patent and that said Letters Patent is hereby corrected as shown below:

On the Cover Page;
change item "(73) Assignee: vYazaki Corporation, Tokyo (JP)" to be -- (73) Assignee: Yazaki Corporation, Tokyo (JP) --

Signed and Sealed this

Twenty-third Day of June, 2009

John Doll

JOHN DOLL
*Acting Director of the United States Patent and Trademark Office*